US005832632A

United States Patent [19]

Bergeron

[11] Patent Number: 5,832,632

[45] Date of Patent: Nov. 10, 1998

[54] WADING BOOT CONSTRUCTION

[76] Inventor: Andy Bergeron, 1150 Church St., Houma, La. 70360

[21] Appl. No.: 883,611

[22] Filed: Jun. 26, 1997

[51] Int. Cl.[6] ..... A43B 23/28; A43C 11/00

[52] U.S. Cl. ..... 36/58.5; 36/50.1; 36/7.1 R

[58] Field of Search ..... 36/91, 89, 7.1 R, 36/58.5, 50.1

[56] References Cited

U.S. PATENT DOCUMENTS

| | | | |
|---|---|---|---|
| Re. 4,748 | 2/1872 | Starrett . | |
| 338,981 | 3/1886 | King . | |
| 899,978 | 9/1908 | Hessler . | |
| 1,673,327 | 6/1928 | Hahn . | |
| 1,877,080 | 9/1932 | Teshima . | |
| 3,235,981 | 2/1966 | Kloss . | |
| 3,327,410 | 6/1967 | Park, Sr. et al. . | |
| 3,574,958 | 4/1971 | Martuch | 36/2.5 |
| 4,713,895 | 12/1987 | Valières | 36/1.5 |
| 4,811,498 | 3/1989 | Barret . | |
| 4,811,500 | 3/1989 | Maccano . | |
| 5,067,260 | 11/1991 | Jenkins, Jr. | 36/7.1 R |

*Primary Examiner*—Ted Kavanaugh
*Attorney, Agent, or Firm*—Henderson & Sturm

[57] ABSTRACT

An improved wading boot construction 10 including a boot member 20 having an upper portion 22 and a sole portion 21 wherein at least one side of the upper portion 22 is provided with a tongue unit 12. The sole portion 21 is provided with a reinforced sole unit 13 having a strap engaging unit 14 which operatively connects the user's footwear 100 to the reinforced sole unit 13.

1 Claim, 2 Drawing Sheets

WADING BOOT CONSTRUCTION

BACKGROUND OF THE INVENTION

1. Field of the Invention

The present invention relates to the field of wading boots in general, and in particular to an oversized wading boot having a shoe attachment system.

2. Description of Related Art

As can be seen by reference to the following U.S. Pat. Nos. 5,067,260; 4,713,895; 1,877,080; and 3,574,958, the prior art is replete with myriad and diverse overboot style wading boots.

While all of the aforementioned prior art constructions are more than adequate for the basic purpose and function for which they have been specifically designed, they are uniformly deficient with respect to their failure to provide a simple, efficient, and practical way to insure that a positive engagement exists between the user's boot or foot and the bottom or boot portion of a user's wader.

As anyone who has traversed marshland or soft mudflats is all too painfully aware, these areas are extremely difficult to traverse due to the "boot sucking" effect encountered therein wherein the users foot is withdrawn relative to the wading boot which is held captive by the vacuum effect created by the mud and water.

As a consequence of the foregoing situation, there has existed a longstanding need for a new and improved type of wading and/or overboot that has a special provision to lift the bottom of the wader simultaneously and in conjunction with the lifting of the user's foot and the provision of such a construction is a stated objective of the present invention.

BRIEF SUMMARY OF THE INVENTION

Briefly stated, the improved wading boot construction that forms the basis of the present invention comprises in general, a reinforced sole unit that is operatively secured to the interior sole portion of a wading boot or overboot and a strap unit which is operatively secured to the reinforced sole unit to immobilize the user's foot and/or shoe relative to the reinforced sole unit.

As will be explained in greater detail further on in the specification, in both the preferred and alternate versions of this invention, at least one side of each wading boot is provided with an enlarged tongue element to permit the user to gain easy access to the strap unit so that the strap unit may be secured over the top of the user's foot and/or shoe.

In this manner, as the user attempts to lift their foot out of the mud or muck, the strap unit will hold the bottom of the user's foot and/or shoe tightly against the sole unit such that the bottom of the wading boot becomes an extension of the sole of the user's foot to break the vacuum forces acting against the outside surface of the wading boot.

BRIEF DESCRIPTION OF THE SEVERAL VIEWS OF THE DRAWINGS

These and other attributes of the invention will become more clear upon a thorough study of the following description of the best mode for carrying out the invention, particularly when reviewed in conjunction with the drawings, wherein.

DETAILED DESCRIPTION OF THE INVENTION

Figure 1:
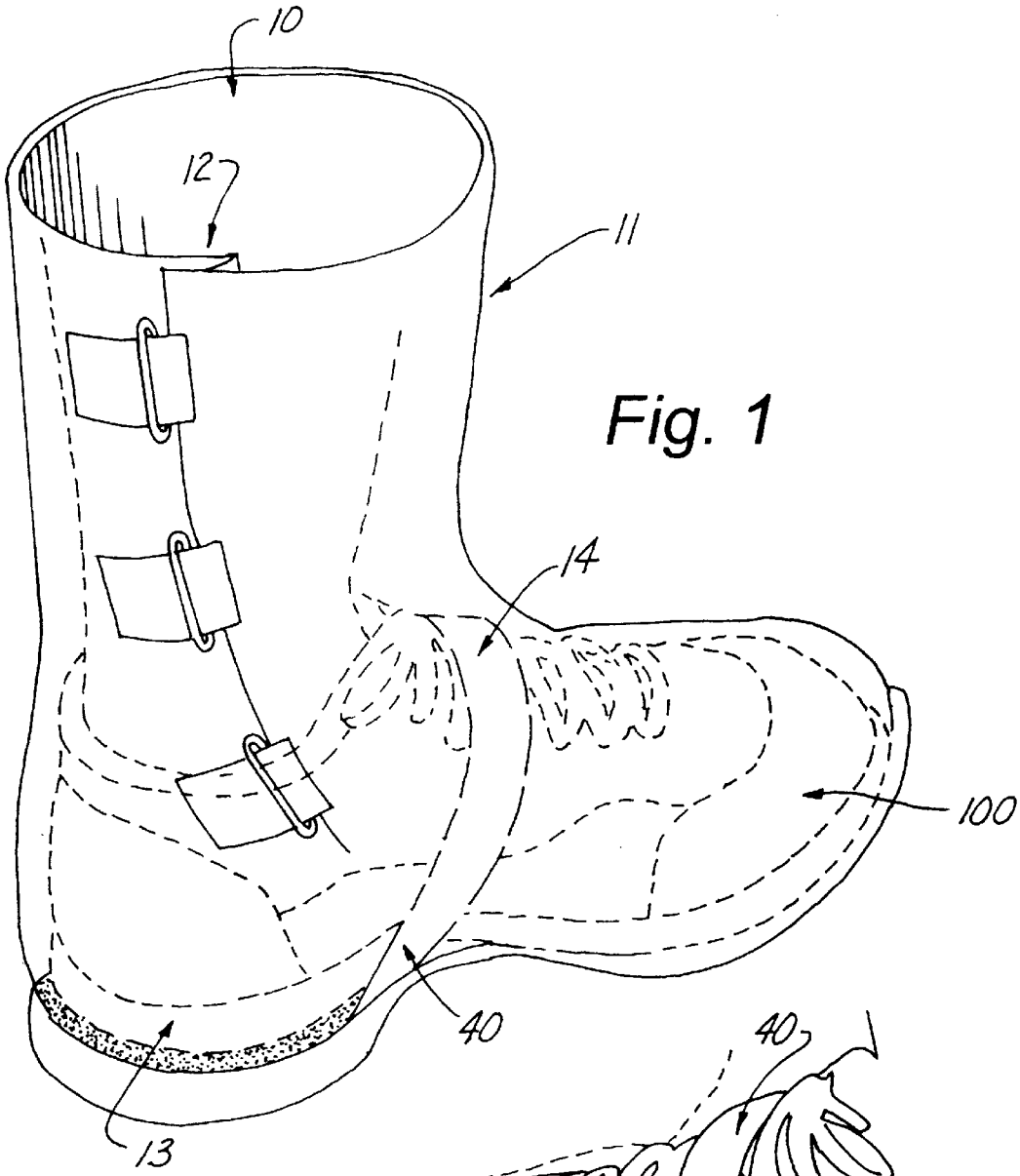
FIG. 1 is a perspective view of the improved wading boot construction that forms the basis of the present invention.

As can be seen by reference to the drawings, and in particularly to FIG. 1, the improved wading boot construction that forms the basis of the present invention is designated generally by the reference number 10. The construction 10 comprises in general, an outer boot unit 11 having an external tongue unit 12, an internal sole reinforcing unit 13, and a securing strap unit 14. These units will now be described in seriatim fashion.

Figure 3:
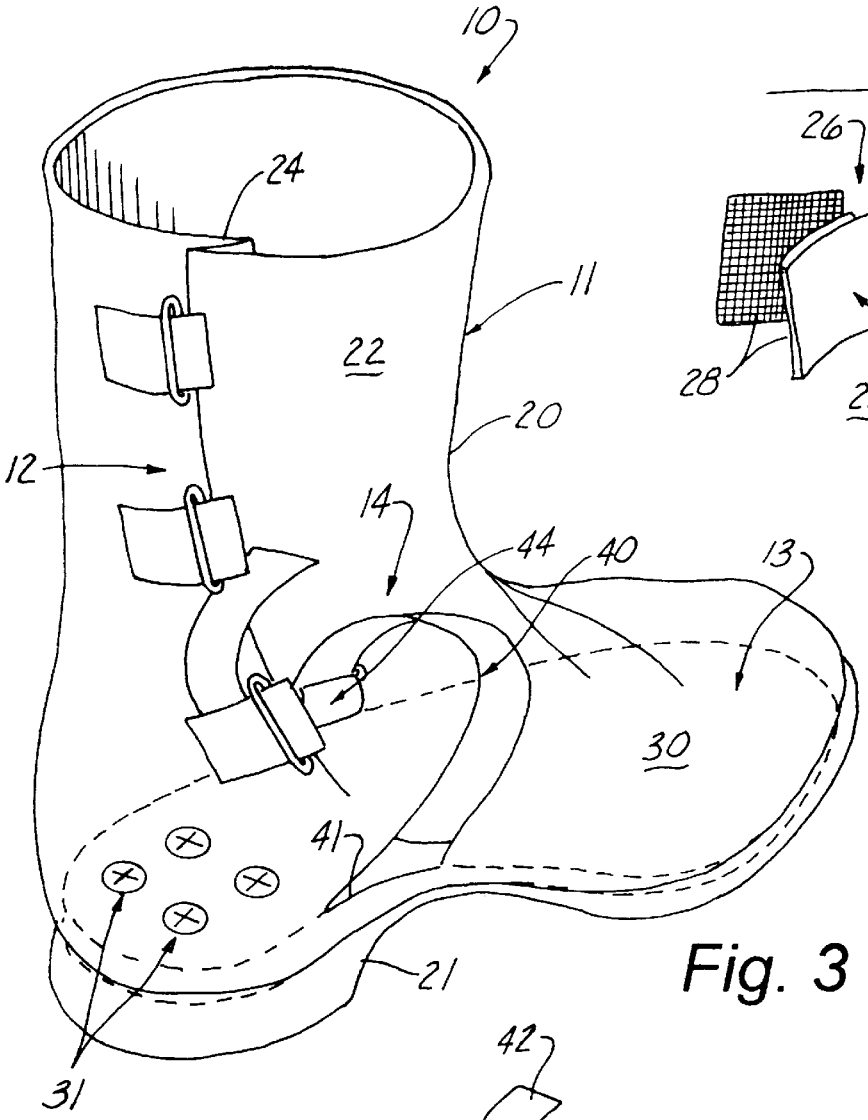
FIG. 3 is a transparent perspective view of the boot construction.

As shown in FIGS. 1 and 3, the outer boot unit 11 comprises a generally conventional boot member 20 having a reinforced sole portion 21 secured to a rubberized upper boot portion 22. At least one side of the upper portion 22 is provided with an external tongue unit 12.

The external side tongue unit 12 comprises in general, an overlapping flap 24 of the upper boot portion 22 wherein one side of the flap 24 is provided with a plurality of strap elements 25 and the other side of the flap 24 is provided with a like plurality of fastening members 26 which are dimensioned to captively engage the strap element 25. The flap terminates in the vicinity of the arch of the sole portion 21.

Figure 4:
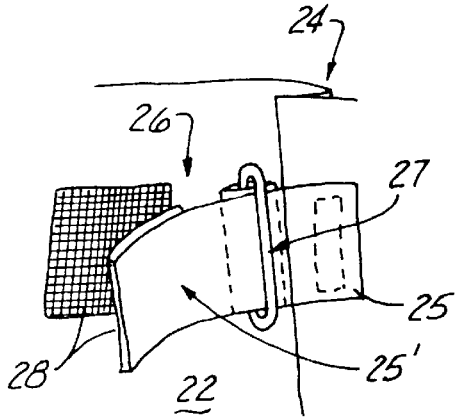
FIG. 4 is an isolated detail view of the tongue closure arrangement.

As can best be seen by reference to FIG. 4, each of the fastening members 26 of the preferred embodiment comprise a loop element 27 dimensioned to receive the free end 25' of the strap elements 25. The free end 25' of the strap element 25 and the adjacent portion of the boot upper portion 22 are provided with hook and loop fasteners 28.

It should be noted at this juncture that not only may any type of adjustable fastening member 26 be substituted for the arrangement herein described, but that the primary reason for the side positioning of the tongue unit 12 is to provide additional access to the arch portion of the user's foot and/or footwear when disposed within the outer boot unit 11 as will be explained presently.

Figure 2:
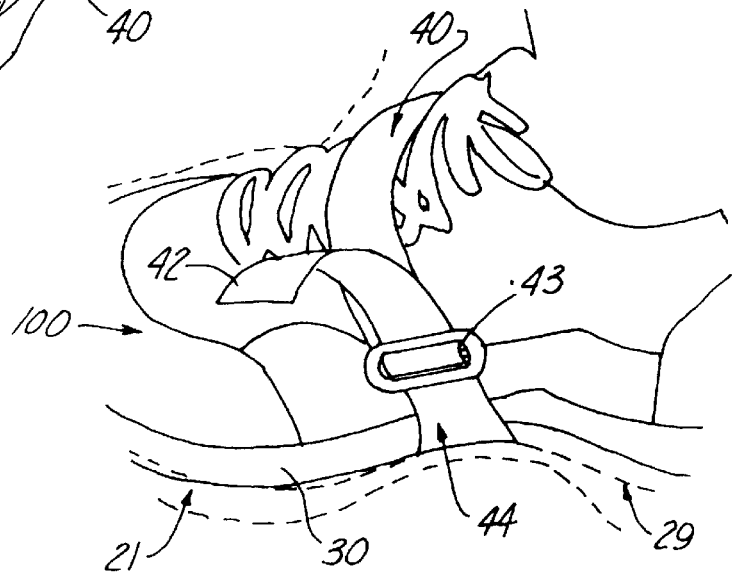
FIG. 2 is an isolated detail view of one portion of the strap unit.
Figure 5:
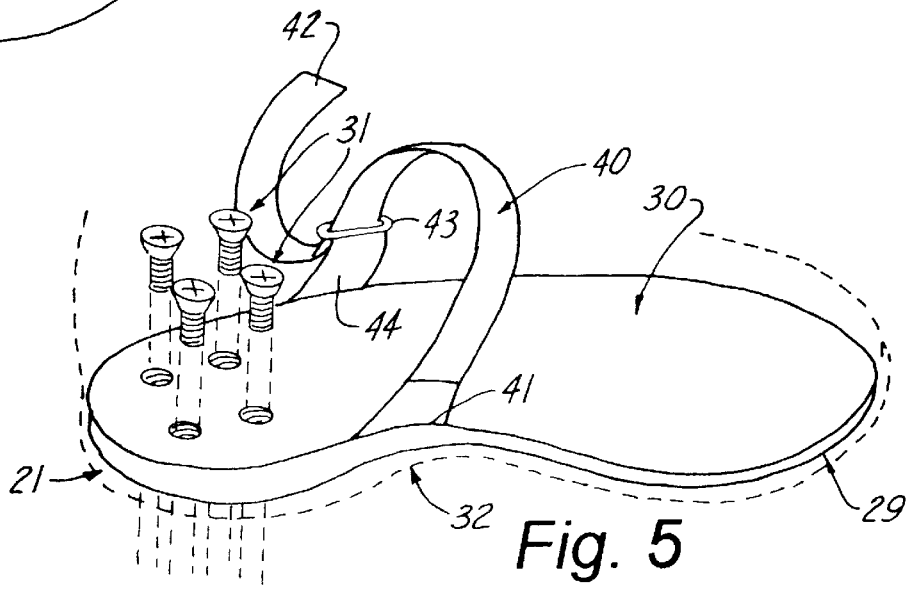
FIG. 5 is an isolated detail view of the sole unit and the strap unit.

Turning now to FIGS. 2, 3, and 5, it can be seen that the internal sole reinforcing unit 13 comprises a generally rigid sole insert member 30 which is fixedly secured to the interior surface 29 of the sole portion 21 of the boot member 20 by conventional fastening means 31 such as screws, adhesives, or the like.

Still referring to FIGS. 2, 3, and 5, it can be seen that the securing strap unit 14 comprises an internal strap member 40 which is fixedly secured on one end 41 to the rigid sole insert member 30 proximate the arch portion 32 of the sole insert member 30. In addition, the strap member 40 has a free end 42 which is adapted to be received by a buckle element 43 which is disposed on a short strap segment 44 for securing the strap unit 14 over the user's footwear 100 in a well recognized fashion.

As was mentioned previously, the wading boot construction 10 which forms the basis of the present invention allows the user to easily insert a boot or other footwear 100 into the confines of the boot member 20 when the side tongue unit

12 is disposed in its open position. Then, once the footwear 100 is positioned within the boot member 20, the user will secure the strap member 40 over the footwear 100 to firmly engage the footwear 100 with the reinforced sole unit 13 and by extension, the bottom of the wading boot member 20.

Once the wading boot construction 10 is properly deployed and the tongue closure straps 25 secured, the user can readily traverse "boot sucking" terrain with confidence since the user's feet will be immobilized within the boot member 20 and all of the force exerted to extract the boot will be applied to the sole 21 of the boot as opposed to the boot upper 22.

Although only an exemplary embodiment of the invention has been described in detail above, those skilled in the art will readily appreciate that many modifications are possible without materially departing from the novel teachings and advantages of this invention. Accordingly, all such modifications are intended to be included within the scope of this invention as defined in the following claims.

In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooded parts together, whereas, a screw employs a helical surface, in the environment of fastening wooden parts, a nail and a screw may be equivalent structures.

I claim:

1. An improved wading boot construction consisting of:

a boot member having a sole portion, an upper portion, and a tongue unit comprising: an overlapping flap formed integrally with one side of the upper portion to expand the opening of the upper portion; a plurality of strap elements provided on one side of said overlapping flap; and a plurality of fastening members provided on the other side of the overlapping flap for captively engaging said strap elements;

a reinforced sole insert member having an arch portion and dimensioned to overlie and be affixed to the sole portion of the boot member; and a strap unit including an elongated strap member secured on one end on one side of the arch portion of the reinforced sole insert member, and a buckle element dimensioned to receive the other end of the strap member, wherein the buckle element is connected to a short strap segment that is attached on one end to the other side of the arch portion of the reinforced sole insert member, wherein the elongated strap member is secured to the reinforced sole insert member on the same side of the upper portion of the boot member as the tongue unit to facilitate the tightening of the strap member to the buckle element.

* * * * *